US010330120B2

(12) United States Patent
Yang

(10) Patent No.: US 10,330,120 B2
(45) Date of Patent: Jun. 25, 2019

(54) BOOST FAN STRUCTURE

(71) Applicant: Delta Electronics, Inc., Taoyuan (TW)

(72) Inventor: Chao-Fu Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 132 days.

(21) Appl. No.: 15/709,670

(22) Filed: Sep. 20, 2017

(65) Prior Publication Data

US 2019/0024676 A1 Jan. 24, 2019

(30) Foreign Application Priority Data

Jul. 18, 2017 (CN) ..... 2017 1 0585541

(51) Int. Cl.

| | |
|---|---|
| ***F04D 29/66*** | (2006.01) |
| ***F04D 25/08*** | (2006.01) |
| ***F04D 29/44*** | (2006.01) |
| ***F04D 29/28*** | (2006.01) |
| ***F04D 29/42*** | (2006.01) |
| *F04D 29/62* | (2006.01) |
| *F04D 29/053* | (2006.01) |
| *F04D 29/056* | (2006.01) |

(52) U.S. Cl.

CPC ..... *F04D 29/663* (2013.01); *F04D 25/08* (2013.01); *F04D 29/281* (2013.01); *F04D 29/4253* (2013.01); *F04D 29/444* (2013.01); *F04D 29/053* (2013.01); *F04D 29/056* (2013.01); *F04D 29/624* (2013.01)

(58) Field of Classification Search

CPC ..... F04D 29/663; F04D 25/08; F04D 29/444; F04D 29/4253; F04D 29/281; F04D 29/053; F04D 29/056; F04D 29/624

See application file for complete search history.

(56) References Cited

U.S. PATENT DOCUMENTS

| | | | | |
|---|---|---|---|---|
| 2012/0138058 | A1* | 6/2012 | Fu | A61M 16/0066 128/204.23 |
| 2016/0290348 | A1* | 10/2016 | Mornan | F04D 17/06 |
| 2018/0142700 | A1* | 5/2018 | Hub | F04D 29/282 |
| 2018/0180058 | A1* | 6/2018 | Hayamitsu | F04D 17/06 |
| 2018/0202465 | A1* | 7/2018 | Randall | E06B 7/02 |
| 2018/0216635 | A1* | 8/2018 | Hayamitsu | A47L 9/22 |
| 2018/0320709 | A1* | 11/2018 | Daly | F04D 29/666 |

* cited by examiner

*Primary Examiner* — Sizo B Vilakazi

(74) *Attorney, Agent, or Firm* — Chun-Ming Shih; HDLS IPR Services

(57) ABSTRACT

A boost fan structure includes a base, a motor driver set, a rotary blade set, and an outer shroud. The base has a frame and an inner guider having a body and plural static blades. The body is disposed in the frame and has an annular curved surface and a receiving space. The static blades are formed on the annular curved surface and exposed out of the frame. The motor driver set is disposed in the receiving space. The rotary blade set is disposed on a side of the inner guider and is driven by the motor driver set to rotate. The outer shroud has a shell having a curved inner wall. The shell covers the rotary blade set and the inner guider to be combined with the frame.

15 Claims, 4 Drawing Sheets

BOOST FAN STRUCTURE

BACKGROUND OF THE INVENTION

Field of the Invention

The present invention relates to a fan structure and in particular to a boost fan structure.

Description of Prior Art

The heat generated by the current popular electronic device is getting increasingly large. For a heat dissipating fan providing forced air flow, a performance index of the heat dissipating fan such as reduced wind pressure loss, increased wind pressure, and reduced noise is urgently required. In this regard, a counter rotating fan or a serially connected fan is commonly used in the current industry to meet the performance. However, the above-mentioned fan has a huge volume, occupying a larger operating space.

For a traditional counter rotating fan, the fixing of its outer frame (including the front frame and the rear frame) is performed to position and secure the fan via the penetration of long screws or the latch design, or by the screws between the front frame and the rear frame. However, the above-mentioned fixing of the outer frame is only suitable for the air channel without an arced shape. If the air channel has a slope or a curvature change (used to guide air flow to increase the wind pressure and reduce the noise) and the above-mentioned fixing method is used, the molding regarding the frame manufacturing cannot be made, which causes difficulty in manufacturing. Therefore, how to design a fan which can maintain the arc of the air channel and meet the requirements of molding and fastening during the manufacturing process is the motivation of the inventor.

In view of this, the inventor pays special attention to research with the application of related theory and tries to improve and overcome the above disadvantages regarding the above related art, which becomes the improvement target of the inventor.

SUMMARY OF THE INVENTION

One objective of the present invention is to provide a boost fan structure which simplifies the structure of the boost fan and decreases the whole volume and has the effects of increasing the wind pressure and reducing the noise.

Another objective of the present invention is to provide a boost fan structure in which the static blades of the body are exposed to a side of the frame in order to facilitate the demolding smoothly during the manufacturing process. Thus, the frame and the inner guider can form the base in an integral way to fulfill the purpose of simplifying the boost fan structure.

To achieve the above objectives, the present invention provides a boost fan structure which comprises a base, a motor driver set, a rotary blade set, and an outer shroud. The base has a frame and an inner guider. The inner guider has a body and a plurality of static blades. The body is disposed in the frame and has an annular curved surface and a receiving space. The static blades are formed on the annular curved surface and exposed to a side of the frame. The motor driver set is disposed in the receiving space. The rotary blade set is disposed on a side of the inner guider; the rotary blade set is driven by the motor driver set to rotate. The outer shroud has a shell having a curved inner wall. The shell covers the rotary blade set and the inner guider to be combined with the frame.

Compared with the prior art, the static blades of the inner guider of the boost fan structure of the present invention are formed on the annular curved surface of the body and exposed to a side of the frame, which facilitates the demolding of the inner guider during the manufacturing process. Also, the base can be formed integrally from the frame and the inner guider by injection molding. In this way, the effects of simplifying fan structure, shrinking the whole volume, and occupying less space are achieved. Besides, the static blade has arch-like surfaces and thus the cross section thicknesses of the static blade have an uneven distribution, which has a better effect of guiding air flow. In addition, the outer shroud of the present invention has a curved inner wall; the static blades are inclined disposed on the annular curved surface and spaced to each other with a vortex-like structure and have arch-like surfaces; the cross section thicknesses of each of the static blades have an uneven distribution. Therefore, a better effect of guiding air flow can be achieved. Consequently, plural air channels are formed between the outer shroud, the annular curved surface, and the static blades, which achieve the effects of reducing the wind resistance and the noise.

DETAILED DESCRIPTION OF THE INVENTION

The detailed description and technical details of the present invention will be explained below with reference to accompanying drawings. However, the accompanying drawings are only for reference and explanation, but not to limit the scope of the present invention.

Figure 1:
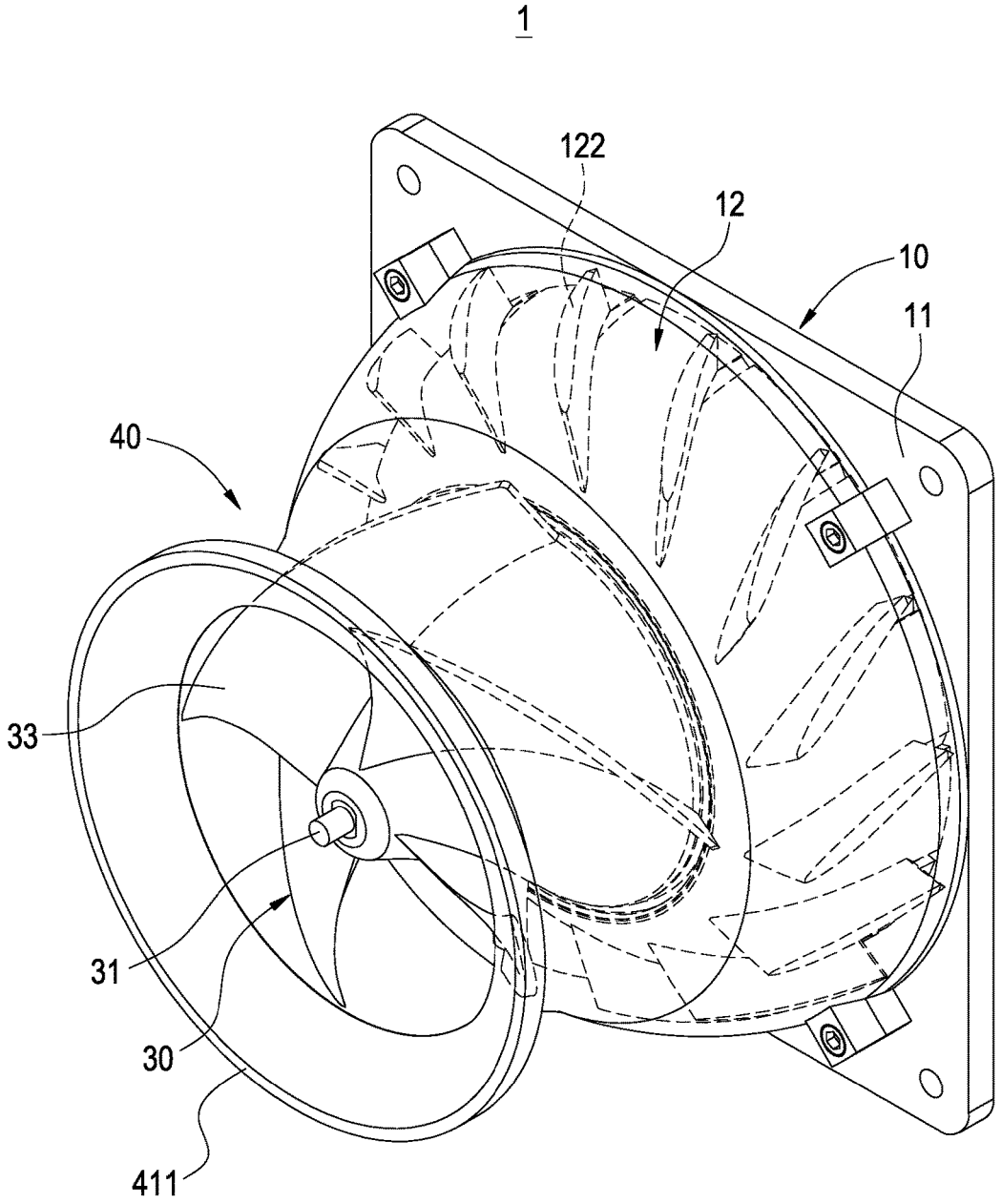
FIG. 1 is a perspective schematic view of the boost fan structure of the present invention from one side.
Figure 2:
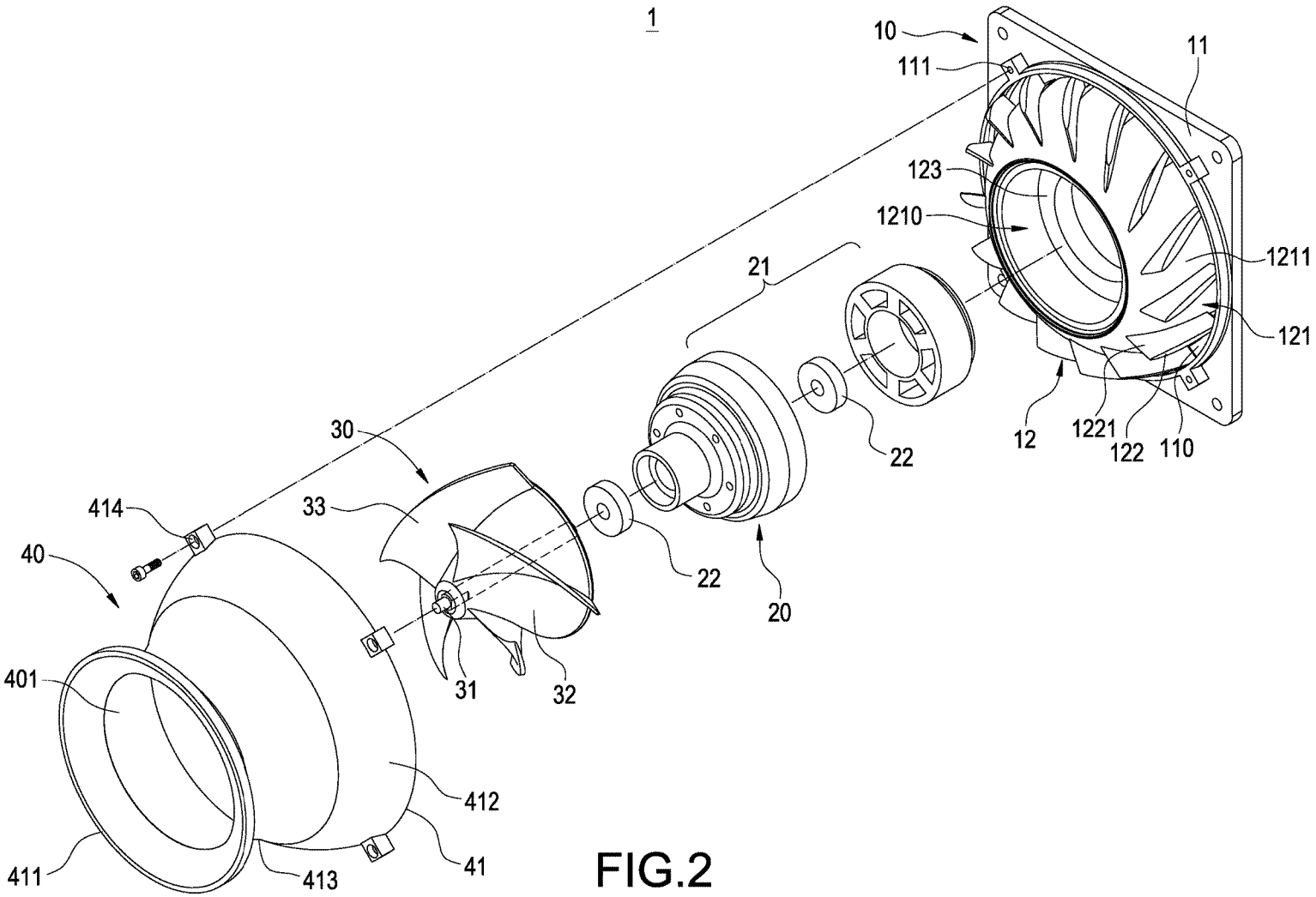
FIG. 2 is an exploded schematic view of the boost fan structure of the present invention.
Figure 3:
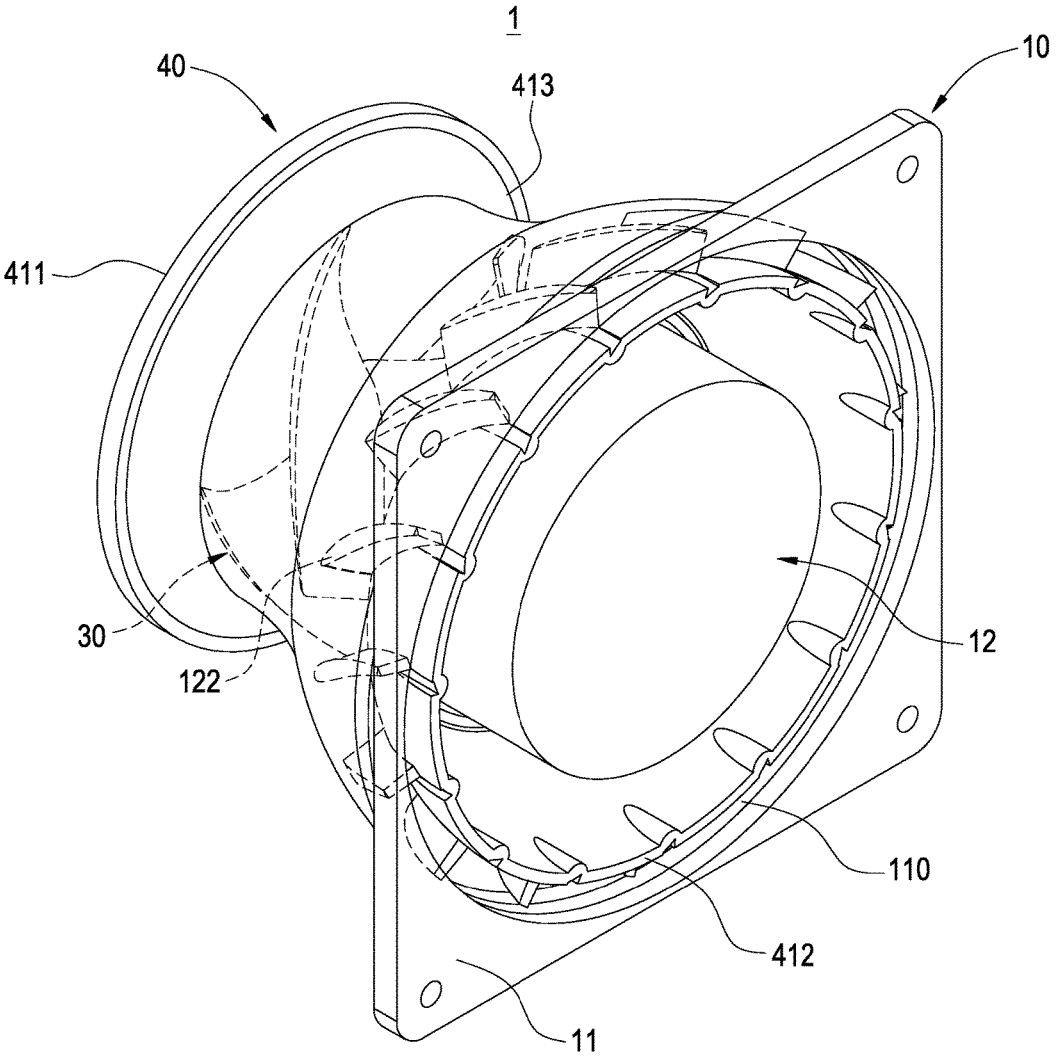
FIG. 3 is a perspective schematic view of the boost fan structure of the present invention from another side.

Please refer to FIGS. 1-3, which are a perspective schematic view of the boost fan structure of the present invention from one side, an exploded schematic view of the boost fan structure of the present invention, and a perspective schematic view of the boost fan structure of the present invention from another side, respectively. The boost fan structure 1 of the present invention comprises a base 10, a motor driver set 20, a rotary blade set 30, and an outer shroud 40. The motor driver set 20 is disposed in the base 10. The rotary blade set 30 is driven by the motor driver set 20 to generate air vortices. The outer shroud 40 covers the rotary blade set 30 and assembled to the base 10. In this way, the air flow generated by the rotary blade set 30 can flow through the outer shroud 40 and is guided by the base 10 to cause a change in the wind pressure. The boost fan structure 1 will be detained later.

The base 10 has a frame 11 and an inner guider 12. The inner guider 12 has a body 121 and a plurality of static blades 122. The body 121 is disposed in the frame 11 and has an annular curved surface 1211 and a receiving space 1210 formed in the annular curved surface 1211. Also, the static blades 122 are directly formed on the annular curved surface 1211 and exposed to a side of the frame 11.

In an embodiment of the present invention, the body 121 forms a supporting base 123 at the bottom of the receiving space 1210. A side of the motor driver set 20 is pressed against the supporting base 123.

The motor driver set 20 is disposed in the receiving space 1210. The rotary blade set 30 is disposed on a side of the inner guider 12 and is driven by the motor driver set 20 to rotate. Besides, the outer shroud 40 has a shell 41 with a curved inner wall 401; the shell 41 covers the rotary blade set 30 and the inner guider 12 to be combined with the frame 11.

In particular, as shown in FIG. 2, the frame 11 has a throughhole 110. Further, a side of the body 121 is disposed through the throughhole 110 and the ends of the static blades 122 are individually extended through the throughhole 110 and formed out of the frame 11, which completes the demolding during the manufacturing process. In this way, the frame 11 and the inner guider 12 can together form the base 10 in an integral way.

In the current embodiment, the static blades 122 are preferably inclined disposed on the annular curved surface 1211 and spaced to each other with a vortex-like structure. It is worth noting that each of the static blades 122 may have arch-like surfaces 1221 or the cross section thicknesses of each of the static blades 122 have an uneven distribution, which achieves a better effect of guiding air flow and reduces the wind resistance and the noise.

Moreover, in an embodiment of the present invention, the motor driver set 20 comprises a motor 21 and at least one bearing 22. The rotary blade set 30 comprises a rotating shaft 31, a cone body 32 and a plurality of blades 33 formed on the cone body 32. Also, the shell 41 has a first opening 411, a second opening 412 opposite to the first opening 411, and a narrow-necked section 413 disposed between the first opening 411 and the second opening 412. In the current embodiment, the size of the first opening 411 is smaller than that of the second opening 412 and thus a high wind pressure can be generated at the side of the first opening 411.

Besides, a plurality of first fixing structures 111 is formed on a side of the frame 11 facing the shell 41. A plurality of second fixing structures 414 is formed at the outer edge surface of the shell 41 which is near to the second opening 412 and corresponds to the first fixing structures 111. The frame 11 and the shell 41 are fastened to each other through the first fixing structures 111 and the second fixing structures 414.

In another embodiment, a first adhering structure (not shown) is formed on a side of the frame 11 facing the shell 41. Also, a second adhering structure (not shown) is formed at the outer edge surface of the shell 41 which is near to the second opening 412 and corresponds to the first adhering structure. The first adhering structure and the second adhering structure are stuck to each other by coating an adhesive to combine the frame 11 and the shell 41. Alternatively, the frame 11 and the shell 41 can be stuck and combined to each other directly through the adhesive.

Figure 4:
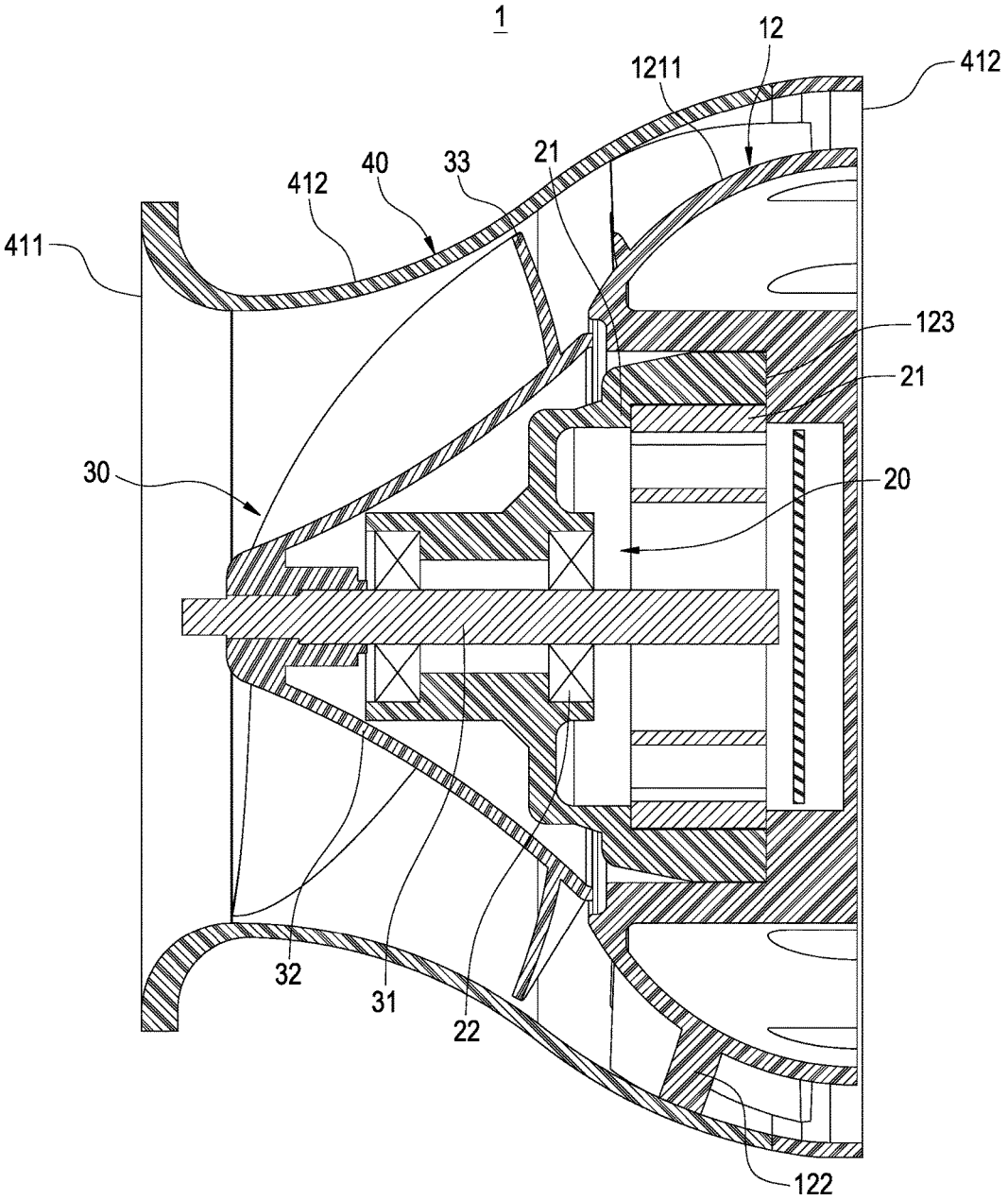
FIG. 4 is an assembled cross-sectional view of the boost fan structure of the present invention.

Please refer to FIG. 4, which is an assembled cross-sectional view of the boost fan structure of the present invention. As shown in FIG. 4, the rotating shaft 31 of the rotary blade set 30 is combined to the motor 21 via the bearing 22. Also, a plurality of air channels is formed between the outer shroud 40, the annular curved surface 1211, and the static blades 122. Preferably, the end of the cone body 32 of the rotary blade set 30 is pressed against an end perimeter of the annular curved surface 1211 of the body 121 and thus a smooth guiding curved surface is formed.

In summary, the embodiments disclosed in the description are only used to explain the present invention, but not to limit the scope of the present invention. The scope of the present invention should be embraced by the accompanying claims and includes all the equivalent modifications and not be limited to the previous description.

What is claimed is:

1. A boost fan structure, comprising:

a base having a frame and an inner guider, wherein the inner guider has a body and a plurality of static blades, wherein the body is disposed in the frame and has an annular curved surface and a receiving space formed in the annular curved surface, wherein the static blades are formed on the annular curved surface and exposed to a side of the frame;

a motor driver set disposed in the receiving space;

a rotary blade set disposed on a side of the inner guider, wherein the rotary blade set is driven by the motor driver set to rotate; and an outer shroud having a shell with a curved inner wall, wherein the shell covers the rotary blade set and the inner guider to be combined with the frame.

2. The boost fan structure according to claim 1, wherein the frame has a throughhole through which a side of the body is disposed, wherein ends of the static blades are individually extended through the throughhole and formed out of the frame.

3. The boost fan structure according to claim 1, wherein a plurality of air channels is formed between the outer shroud, the annular curved surface, and the static blades.

4. The boost fan structure according to claim 1, wherein the body forms a supporting base at the bottom of the receiving space, wherein a side of the motor driver set is pressed against the supporting base.

5. The boost fan structure according to claim 1, wherein each of the static blades has an arch-like surface.

6. The boost fan structure according to claim 1, wherein the cross section thicknesses of each of the static blades have an uneven distribution.

7. The boost fan structure according to claim 1, wherein the static blades are inclined disposed on the annular curved surface and spaced to each other with a vortex-like structure.

8. The boost fan structure according to claim 1, wherein the rotary blade set has a rotating shaft, wherein the motor driver set comprises a motor and at least one bearing, wherein the rotating shaft is combined in the motor via the bearing.

9. The boost fan structure according to claim 1, wherein the rotary blade set comprises a cone body and a plurality of blades formed on the cone body.

10. The boost fan structure according to claim 9, wherein an end of the cone body is pressed against an end perimeter of the annular curved surface.

11. The boost fan structure according to claim 1, wherein the shell has a first opening, a second opening opposite to the first opening, and a narrow-necked section disposed between the first opening and the second opening.

12. The boost fan structure according to claim 11, wherein the size of the first opening is smaller than that of the second opening.

13. The boost fan structure according to claim 11, wherein a plurality of first fixing structures is formed on a side of the frame facing the shell, wherein a plurality of second fixing structures is formed at the outer edge surface of the shell which is near to the second opening and corresponds to the first fixing structures, wherein the frame and the shell are fastened to each other through the first fixing structures and the second fixing structures.

14. The boost fan structure according to claim 11, wherein a first adhering structure is formed on a side of the frame facing the shell, wherein a second adhering structure is formed at the outer edge surface of the shell which is near to the second opening and corresponds to the first adhering structure, wherein the first adhering structure and the second adhering structure are stuck to each other by coating an adhesive.

15. The boost fan structure according to claim 1, wherein the frame and the shell are stuck and combined to each other via an adhesive.

* * * * *